United States Patent [19]

Salisbury

[11] 3,998,510

[45] Dec. 21, 1976

[54] METHOD OF USING INVISIBLE SPACERS FOR ELECTRO-OPTICAL DISPLAY DEVICE MANUFACTURE

[75] Inventor: Charles W. Salisbury, Risingsun, Ohio

[73] Assignee: Owens-Illinois, Inc., Toledo, Ohio

[22] Filed: Dec. 23, 1974

[21] Appl. No.: 535,247

[52] U.S. Cl. ..... 316/17; 29/25.13; 313/220; 316/4

[51] Int. Cl.[2] ..... H01J 9/40

[58] Field of Search ..... 316/17, 4; 313/220; 29/25.13

[56] References Cited

UNITED STATES PATENTS

| | | | |
|---|---|---|---|
| 3,041,127 | 6/1962 | Turnbull | 316/19 |
| 3,499,167 | 3/1970 | Baker et al. | 315/169 |
| 3,602,756 | 8/1971 | Bonnet | 313/109.5 |
| 3,778,126 | 12/1973 | Wilson | 316/20 |
| 3,858,284 | 1/1975 | Costa et al. | 29/25.13 |
| 3,879,629 | 4/1975 | Durand | 313/220 |

OTHER PUBLICATIONS

Beckman et al., "Gas Panel Sealant", IBM Tech. Discl. Bull., vol. 15, No. 8, Jan. 1973, pp. 2518–2519.

*Primary Examiner*—Victor A. DiPalma
*Attorney, Agent, or Firm*—Donald Keith Wedding

[57] ABSTRACT

Stainless steel discs with a Brinell hardness of about 150 to 240 provide excellent invisible spacers for maintaining proper gas chamber gaps in electro-optical display devices. These spacers approximately about 8 to 20 mils in diameter and about 3 to 7 mils thick improve spacing uniformity in the viewing area and minimize firing site or cell wipe-out.

6 Claims, 2 Drawing Figures

METHOD OF USING INVISIBLE SPACERS FOR ELECTRO-OPTICAL DISPLAY DEVICE MANUFACTURE

BACKGROUND OF THE INVENTION

This invention relates to the manufacture of gas discharge devices, especialy A.C. (alternating current) multiple gas discharge display/memory devices which have an electrical memory and which are capable of producing a visual display or representation of data such as numerals, letters, radar displays, aircraft displays, binary words, educational displays, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to be physically isolated relative to other cells. In either case, with or without the confining physical structure, charges (electrons, ions) produced upon ionizaton of the elemental gas volume of a selected discharge cell, when proper alternating operation potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on a opposing elemental or discrete dielectric surface area on alternate half cycles to constitute an electrical memory.

An example of a panel structure containing non-physically isolated or open discharge cells is disclosed in U.S. Pat. No. 3,499,167 (incorporated herein by reference) issued to Theodore C. Baker, et al.

An example of a panel containing physically isolated cells is disclosed in the article by D. L. Bitzer and H. G. Slottow entitled "The Plasma Display Panel—A Digitally Addressable Display With Inherent Memory", Proceeding of the Fall Joint Computer Conference, IEEE, San Francisco, California, Nov. 1966, pages 541–547 and also in U.S. Pat. No. 3,559,190 (incorporated herein by reference).

In the construction of the panel, a continuous volume of ionizable gas is confined between a pair of dielectric surfaces backed by conductor arrays typically forming matrix elements. The two conductor arrays may be orthogonally related sets of parallel lines (but any other configuration of conductor arrays may be used). The two arrays define at their intersections a plurality of opposed pairs of charge storage areas on the surfaces of the dielectric bounding or confining the gas. Thus, for conductor matrix having H rows and C columns the number of elemental or discrete areas will be twice the number of elemental discharge cells.

In addition, the panel may comprise a so-called monolithic structure in which the conductor arrays are created on a single substrate and wherein two or more arrays ar separated from each other and from the gaseous medium by at least one insulating member. In such a device the gas discharge takes place not between two opposing elemental areas on two different substrates, but between two contiguous or adjacent elemental areas on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In the prior art there exists D.D. (direct current) devices where the electrodes consist of an anode and a cathode which are typically in direct contact with the ionizable gaseous medium. It is also possible to construct such D.C. devices utilizing a dielectric overcoat, i.e., the same structure and configuration as an A.C. gas discharge display/memory panel described hereinbefore.

A wide variety of such devices exist in the prior art. Examples of such devices are disclosed in U.S. Pat. Nos. 2,142,106; 3,260,880; 3,720,452; 3,725,713; 3,237,040, and 3,497,751, all of which are incorporated herein by reference.

The present invention is intended to relate to the manufacture of all types of A.C. and D.C. display panels.

In addition to the matrix configuration, the conductor arrays of the display device (D.C. or A.C.) may be shaped otherwise. Accordingly, while the preferred conductor arrangement is of the crossed grid type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly (e.g., a segmented digit display).

The gas is selected to produce visible light and invisible radiation which may be used to stimulate a phosphor (if visual display is an objective) and a copious supply of charges (ions and electrons) during discharge.

In the prior art, a wide variety of gases and gas mixtures have been utilized as the gaseous medium in a number of different gas discharge devices. Typical of such gases include pure gases and mixture of CO; $CO_2$; halogens; nitrogen; $NH_3$; oxygen; water vapor; hydrogen; hydrocarbons; $P_2O_5$; boron fluoride; acid fumes; $TiCl_4$; air; $H_2O_2$; vapors of sodium, mercury, thallium, cadmium, rubidium, and cesium; carbon disulfide; $H_2S$; deoxygenated air; phosphorus vapors; $C_2H_2$; $CH_4$; naphthalene vapor; anthracene; freon; ethyl alcohol; methylene bromide; heavy hydrogen; electron attaching gases; sulfur hexafluoride; tritium; radioactive gases; and the so-called rare or inert Group VIII gases.

To obtain uniform resolution over the entire display surface of a gas discharge panel, it is imperative that the space between opposing walls of the gas envelope be uniform and that the walls of the chamber be sealed to provide a gas filled container.

Several methods of sealing such panels with various spacers therebetween appear in the prior art. For example, epoxy has been used as a sealant but produces impurities in the gas mixture which decreases the life of the panel. In situ fabrication of gas panels with granular solder glass as a sealant and spacers has also been utilized but uniform deposition of the solder glass is difficult and considerable numbers of cells are obliterated. In order to resolve these problems a soft glass rod or granular sealant and a hard glass rod spacer as has been used, as described in U.S. Pat. No. 3,778,127 (incorporated herein by reference) wherein the upper plate of the gas panel settles upon the spacing rods during a bakeout operation thus establishing a predetermined and uniform spacing within the envelope. However, such glass spacers are rigid, tend to crack and are detrimentally conspicuous to the observer.

Another glass sealing composition especially suitable for sealing together the two glass substrates of a multiple gas discharge display panel so as to provide a hermetically sealed ionizable gas chamber is disclosed in U.S. Pat. No. 3,734,702 (incorporated herein by reference) comprising a lead borosilicate solder glass containing 18 percent by weight of aluminum titanate which inhibits crystallization thus developing a seal with even stress concentration.

SUMMARY OF THE INVENTION

In the practice of this invention, it has been discovered that stainless steel discs of the proper configuration and hardness can be placed in the areas between the electrodes on one glass substrate of an electro-optical display panel so that they are situated between firing sites when the top glass substrate is applied and sealed. Conventional solder glasses such as lead borosilicate and lead-zinc-borate glasses are used as sealants. During the sealing cycle, the substrates are clamped so that when the sealing solder glass flows, the discs indent the dielectric slightly due to the heat cycle and clamp pressure and remain in position. These stainless steel spacers upon evacuation and gas processing eliminate deflection of the substrates and maintain a predetermined gas chamber gap with invisible qualities.

PREFERRED EMBODIMENTS OF THE INVENTION

Figure 1:
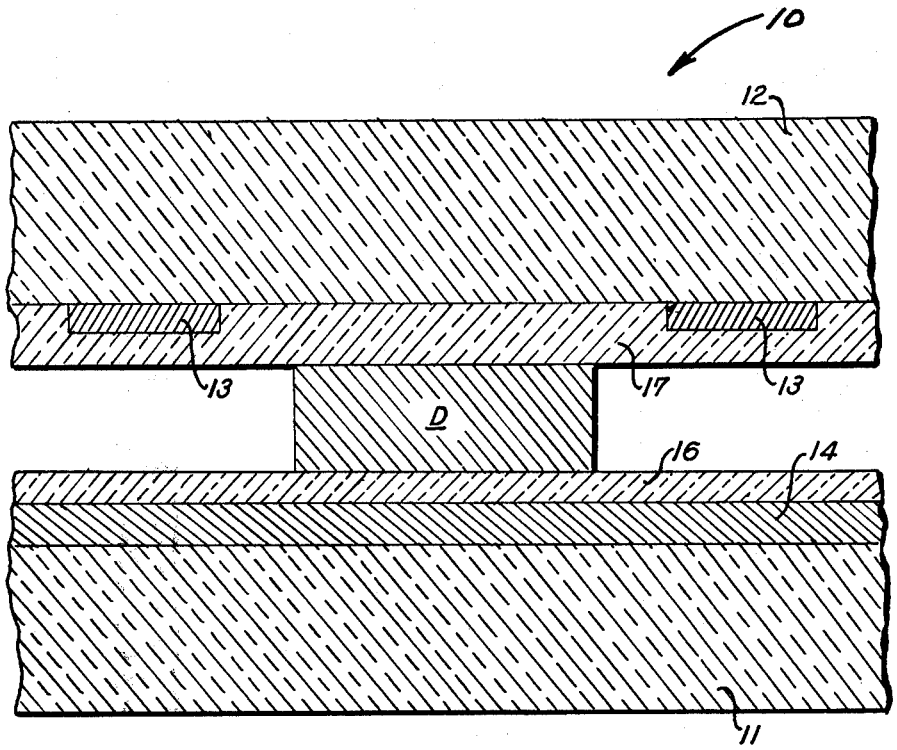
FIG. 1 is a cross-sectional view of a portion of a gas discharge display panel of the type shown in the aforementioned Baker et al. U.S. Pat. No. 3,499,167 and constructed according to the process of the present invention and, FIG. 2 is a diagrammatic illustration of the discs used in accordance with the process of the present invention.
Figure 2:
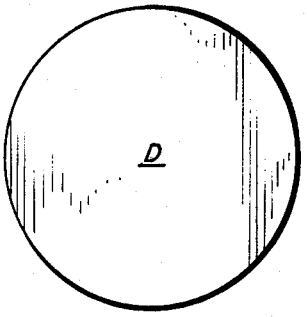

The discs D employed as spacers in the present invention are composed of stainless steel with a Brinell hardness number of from about 150 to 240. Suitable stainless steel compositions include Inconel which is a nickel-chromium alloy made by International Nickel Co., Inc. containing 72 percent nickel, 16 percent chromium, 8 percent iron and 2 percent silica having a Brinell hardness number of 160 to 190. Other stainless steel compositions which are satisfactory include American Iron and Steel Institute (AISI) type No. 302 containing 8 to 10 percent nickel, 17 to 19 percent chromium, 71 to 75 percent iron and 2 percent manganese having a Brinell hardness number of from 150 to 240; also AISI type No. 304 with 8 to 12 percent nickel, 18 to 20 percent chromium, 68 to 74 percent iron, 2 percent manganese and 1 percent silica; likewise AISI tpe No. 321 containing 9 to 12 percent nickel, 17 to 19 percent chromium, 69 to 74 percent iron and minor amounts of manganese and silica having a Brinell hardness number of about 150 to 160. Compositions containing copper or brass are much too soft and have been found to be unsatisfactory as spacers for electro-optical display devices. For the purposes of this invention any stainless steel with a Brinell hardness number within the range specified is operable as a spacer.

The stainless steel spacers D contemplated can be of any configuration such as in the form of rectangles, squares, triangles or circles but preferably discs with variable diameters of from about 8 to 20 mils and about 3 to 7 mils thick so that the proper gas chamber gap can be maintained between the substrates of the display devices.

In one specific embodiment the stainless steel spacers of this invention are used in the manufacture of multiple gas discharge display panels having an electrical memory and capable of producing a visual color display such as letters or numerals. A commercial sealing glass composition comprising 75 percent PbO, 12.6 percent ZnO, 2 percent BaO, 8.13 percent $B_2O_3$ and 2.1 percent $SiO_2$ is used to seal the components of such panels, especially the glass substrates which support the electrodes and other elements.

The panels 10 are assembled by first vacuum depositing gold conductor arrays at preselected intervals preferably 512 lines per inch in transverse fashion on two glass plates 11 and 12 made of conventional soda-lime-silicate glass about 0.25 inch in thickness. Each conductor array 13 and 14 is then sprayed with a 1 mil thick dielectric layer 16 and 17, respectively, of lead-borosilicate glass composed of 73 percent PbO, 13 percent $B_2O_3$, 13 percent $SiO_2$ and fired at about 600°C. One of the plates is provided with a hole (not shown) for tube coupling. Inconel or stainless steel discs D about 5 mils thick and 10 mils in diameter are placed between the firing sites of the lower plate and the sealing glass is applied to the outer edges of said plate before the upper plate with its exhaust outlet is clamped thereto. The entire assembly is placed in an oven and heated at about 400°to 450°C. to fuse the component parts into a single integral unit with a uniform gap of about 5 mils between the glass plates. The confined space in the panel is filled with an inert gas such as neon and the exhaust tube is sealed. The completely assembled gas display panel with its invisible stainless steel spacers is now ready for use by ionizing the gas of a selected discharge unit. The dielectric layers prevent the passage of any conductive current from the conductor arrays to the gaseous medium and also serve as collecting surfaces for ionized electrons during the alternate half cycles of the operating potentials to constitute an electrical memory. In actual operation, these panels minimize firing site wipe-outs, provide invisible supports for the substrates in the viewing areas, eliminate checks in the dielectric and no reflective glow occurs at the spacer from adjacent cell firing.

While the invention has been described with reference to a preferred embodiment, it should be understood that various omissions, substitutions and changes in form and detail may be made by those skilled in the art without departing from the spirit and scope of the invention.

I claim:

1. In a process for manufacturing a gaseous discharge display device characterized by an ionizable gaseous medium in a gas chamber formed by sealingly joining two planar glass substrates which are parallel around their facing surfaces, the improvement wherein the gas chamber discharge gap between the substrates and defined by said facing surfaces is kept uniform during said process for manufacturing and thereafter by positioning inconspicuous stainless steel spacer members therebetween on one of said glass substrates, said discs having a Brinell hardness number of from about 150 to 240, and thereafter sealing said substrates with a sealing glass composition by the application of heat and pressure sufficient to melt the sealing glass and firmly imbed the discs in the opposing substrate surfaces between firing sites.

2. The process of claim 1 wherein said spacer members are stainless steel discs about 3 to 7 mils thick and about 8 to 20 mils in diameter.

3. The process of claim 1 wherein said spacer members are stainless steel discs having a Brinell hardness number of about 160 to 190.

4. The process of claim 1 wherein said spacer members are stainless steel discs which are 5 mils thick and 10 mils in diameter.

5. The process of claim 1 wherein said substrates are heated to about 400° to 450° C. to fuse and seal them into a single integral unit.

6. The process of claim 1 wherein the discs are coated with a low temperature frit for sealing them to both substrates during the application of said heat and pressure.

* * * * *